US006152030A

United States Patent [19]

Fuqua

[11] Patent Number: 6,152,030

[45] Date of Patent: Nov. 28, 2000

[54] CURING APPARATUS FOR A MULTI-COLOR SCREEN PRINTING SYSTEM

[76] Inventor: Rick Lee Fuqua, 10758 Gettysburg Pl., Carmel, Ind. 46032

[21] Appl. No.: 09/253,816

[22] Filed: Feb. 19, 1999

[51] Int. Cl.[7] ..... B41F 15/12

[52] U.S. Cl. ..... 101/115; 34/268; 101/424.1; 101/488

[58] Field of Search ..... 101/115, 123, 101/424.1, 488; 34/268, 269

[56] References Cited

U.S. PATENT DOCUMENTS

| | | | |
|---|---|---|---|
| 1,479,819 | 1/1924 | Kluever | 101/424.1 |
| 3,950,650 | 4/1976 | Pray et al. . | |
| 4,434,562 | 3/1984 | Bubley et al. . | |
| 4,474,109 | 10/1984 | Yara | 101/115 |
| 4,504,220 | 3/1985 | Sunakawa et al. . | |
| 4,671,174 | 6/1987 | Tartaglia et al. . | |
| 4,813,351 | 3/1989 | Pierson, Jr. . | |
| 4,864,145 | 9/1989 | Burgio, Jr. . | |
| 5,010,659 | 4/1991 | Televen | 34/155 |
| 5,086,700 | 2/1992 | Van Den Berg . | |
| 5,132,519 | 7/1992 | Jackson et al. | 219/388 |
| 5,136,938 | 8/1992 | Pellegrina | 101/115 |
| 5,154,119 | 10/1992 | Fuqua et al. . | |
| 5,249,255 | 9/1993 | Fuqua et al. . | |
| 5,471,924 | 12/1995 | Helling . | |
| 5,595,113 | 1/1997 | Daniel et al. . | |
| 5,622,108 | 4/1997 | Benedetto et al. . | |
| 5,809,877 | 9/1998 | Szyszko et al. . | |
| 5,908,000 | 6/1999 | Spychalla et al. | 101/115 |

OTHER PUBLICATIONS

M & R Sales and Service, Inc. Brochure 1097T Flash Cure Systems pp. 16–18.

*Primary Examiner*—John S. Hilten
*Assistant Examiner*—Leslie J. Grohusky

[57] ABSTRACT

A drying/curing apparatus for a rotary screen printing machine includes a carriage supporting a flash curing unit. The curing unit has a height or thickness that is less than the gap between the workpiece platen of the printing machine and the printing screen. The drying apparatus includes a structure attached to a print station of the printing machine that is configured to permit reciprocation of the curing unit across a substrate supported on the workpiece platen after an ink layer has been applied to the substrate and the platen has been retracted from the print screen. The curing unit includes a plurality of heat generating elements, such as high power quartz lamps, that are directed toward the ink layer on the substrate. The curing unit includes an insulator plate disposed between the curing lamps and the printing screen of the printing machine when the curing unit travels across the workpiece platen. In addition, the curing unit includes a number of channel shaped reflector elements mounted to the underside of the insulator plate with the curing lamps disposed within the reflective channel. Adjacent reflector elements are spaced apart to define a ventilation gap or channel therebetween. In addition, the side walls of the channel shaped reflector elements define a series of ventilation slots. The reflector elements are mounted so that the ventilation slots of adjacent side walls are offset from each other. The drying apparatus also includes a blower device at the neutral position of the curing unit to direct cooling air across the curing lamps and reflector elements. An air deflector is provided to prevent air flow across the ink layer or printing screen.

23 Claims, 7 Drawing Sheets

CURING APPARATUS FOR A MULTI-COLOR SCREEN PRINTING SYSTEM

BACKGROUND OF THE INVENTION

The present invention relates to the field of printing, and more particularly to screen printing systems. Specifically, the present invention concerns an apparatus for curing or drying an ink layer applied to a workpiece by the screen printing system.

Printed patterns or indicia applied to articles of clothing, such as t-shirts, have become extremely popular. As the popularity of such clothing increases, the demand for high volume production also increases. In the past, a single printing press would be sufficient to meet the demand for certain articles of clothing. Now, technically advanced printing systems exist that require only minimal human intervention while maximizing the product output.

In addition, the degree of consumer sophistication has increased. Where once a single-color print on a single-color shirt was acceptable, now printed indicia on articles of clothing can consist of ten or more colors in complicated designs. Moreover, consumer demand for dark colored shirts with screen printed indicia has increased.

At one time, multiple color printing posed a significant impediment to the mass production of articles bearing printed indicia. However, the advent of the multi-station, turret-type printing press made high volume production of these articles of clothing highly feasible. A printing system of this type is depicted in FIG. 1. One such rotary printing apparatus 10 utilizes a screen printing process. The apparatus 10 includes a floor-mounted support base from which extends a shaft 12. A hub 13 is mounted on the shaft 12 for rotation in the direction of the arrow R and upward-downward movement in the direction of the arrow D. This rotary printing system 10 includes a plurality of stations $\mathbf{15}_a$–$\mathbf{15}_h$. Each station includes a support arm 16 that is centrally mounted relative to the base 11 and shaft 12. The stations $\mathbf{15}_a$–$\mathbf{15}_h$ each include a print carriage 18 that is operable in a screen printing process. The print carriage is movably supported by a pair of guide head portions 19*a* and 19*b* relative to the corresponding support arm 16. Also mounted to the support arm 16 at each of the stations is a mechanism for clamping a silk screen frame, comprising an outer clamp 21 and an inner clamp 22.

Details of the silk screen printing portion of the rotary apparatus 10 are found in FIG. 2. As shown in this more detailed view, the print carriage 18 includes a flood bar 36 that applies ink to the screen and a squeegee 37 that draws the ink across and through the screen. These components are mounted to the guide head portions 19*a* and 19*b*. Movement of the guide head portions, and consequently the print carriage 18 is accomplished by way of a pair of guide shafts 32 that are supported at the free end of the station by a front support 33. The front support 33 is attached to the end of the support arm 16 at each station, such as station 15*h*. The opposite ends of the guide shafts 32 are supported at a rear support 31, which is also connected to the support arm. The guide head portions 19*a* and 19*b* are attached to a center support 20 that is configured for sliding along the length of each of the guide shafts 32, typically under pneumatic or electric power.

The rotary printing apparatus 10 also includes a plurality of screen frames 34 supporting a tensioned screen 35. The screen 35 carries the particular image to be printed on the article. The screen frame 34 is supported between the outer clamp 21 and the inner clamp 22. Each of the clamps carries a pair of clamping cylinders 23 that exert a downward force on the screen frame 34 to lock the frame in position. The clamps 21, 22 are attached to the support arm 16 through the front and rear supports 32, 31, respectively.

Referring again to FIG. 1, the rotary printing apparatus 10 includes a plurality of workpiece platens $\mathbf{25}_a$–$\mathbf{25}_j$. Each of the platens is engaged to the hub 13 by a support arm 26. In operation, each workpiece platen 25 rotates and raises or lowers with the controlled movement of the hub 13. The apparatus 10 includes a controller 30 that governs the operation and movement of the hub, and therefore the workpiece platens 25. In addition, the controller 30 controls the linear movement of each print carriage 18 that cross the screen 35 at each of the printing stations.

In the typical rotary printing apparatus, such as the apparatus 10, the number of workpiece platens 25 exceeds the number of stations 15 by two. Thus, as shown in FIG. 1, a first workpiece platen $\mathbf{25}_a$ is situated at a loading station while the last platen $\mathbf{25}_j$ is at an unloading station. The remaining workpiece platens $\mathbf{25}_d$–$\mathbf{25}_i$ are in registry with corresponding ones of the stations $\mathbf{15}_a$–$\mathbf{15}_h$. In operation of the rotary apparatus 10, a worker manually loads an item, such as an article of clothing, onto the workpiece platen $\mathbf{25}_a$ at the loading station 28. Generally contemporaneously, the worker removes the completed printed item from the platen $\mathbf{25}_j$ at the unloading station 29. The controller 30 then sequences the rotary assembly by rotating the hub 13 and therefore each of the workpiece platens 25 to the next subsequent station. The controller then directs the print carriage at each station $\mathbf{15}_a$–$\mathbf{15}_h$ to apply ink in a silk screen process to the workpiece. Typically, the ink at each station is a different color. In this configuration, a new workpiece is loaded and a finished product unloaded each time the controller 30 indexes the workpiece platens $\mathbf{25}_a$–$\mathbf{25}_j$.

The controller 30 is electrically connected to actuators for each component at each station. The controller sends a predetermined, and often user-modifiable, sequence of activation and de-activation commands to these actuators to perform the various functions of the printing apparatus 10. For instance, when the platens are indexed to the next station, the controller provides a command to a motor or air cylinder driving the shaft 12 or hub 13. The motor is precisely controlled so that each workpiece platen 25 is precisely located beneath a printing screen 35 at each station. The controller next issues a signal to raise the hub 13 and consequently each platen $\mathbf{25}_a$–$\mathbf{25}_j$ so that the work in process carried by the platen is brought into direct pressure contact with the printing screen. Another signal activates each print carriage 18 to apply the ink layer to the workpiece substrate. The cycle time for each print carriage can vary depending upon the nature of the ink and the applied pattern. Once the last print carriage has returned to its home position, the controller sends a signal to retract the workpiece platens to prepare for indexing the platen to the next station.

In many types of silk screen process, such as printing on light colored substrates, only a thin layer of ink is applied to the workpiece substrate. In some cases, the absorbency of the substrate material eliminates the need for a separate drying apparatus. Moreover, exposure to ambient air is often sufficient to adequately cure or dry the applied ink. Each applied layer of ink has a drying time that is less than the cycle time for the screen printing apparatus 10. The amount of time that each ink application is exposed to ambient air depends upon how quickly the workpiece platens 25 are rotated from one station to the next and the print carriage 18 at the next station is activated.

Frequently, screen printing apparatuses augment the ambient air drying by interposing heated elements. In one installation, electrical resistance heating elements are situated in proximity with each station 15. The heating elements impart radiative and/or convective heat to the printed material between successive printing operations sufficient to cure the newly applied layer of ink. Overheating of the printed work may result in wrinkles, discoloration, shrinkage, and/or scorching of the applied ink and the underlying material. Consequently, it is important that the heat application be closely controlled when independent heating elements are being utilized.

In certain installations, the initial platen $\mathbf{25}_a$ at station 28 can be used as both a loading and an unloading station. With this approach, the worker simply removes a finished product from the platen $\mathbf{25}_a$ and installs a new item onto the platen. With this configuration, the station 29 can be a drying station. In certain screen printing operations, the ink is sufficiently cured during layer the drying time between successive stations to accept a subsequent application of ink. However, before the item is removed from the workpiece platen, a final cure or drying operation may be necessary at the station 29.

One such system is illustrated in U.S. Pat. No. 5,249,255. This system utilizes an infrared lamp and a blower to cure the ink on a printed item traveling beneath the portable curing apparatus. The amount of time that the substrate and ink layer is exposed to the curing apparatus again depends upon the cycle time for the overall rotary printing apparatus. This cycle time can be as short at 4–6 seconds or as long as 20–30 seconds in various commercial environments. Once the item is fully dried or cured, the platen $\mathbf{25}_j$ at the drying station 29 is indexed to the unloading/loading station 28, whereupon the finished product is removed by the worker.

As indicated above, many screen printing operations rely upon very thin layers of ink so that exposure to ambient air is sufficient for adequate curing. However, other applications require a heavier layer of applied ink. For instance, before printing on a black material, such as a black T-shirt, it is typically necessary to apply a heavy layer of white ink to completely cover up the black substrate. In this instance, simply exposing the thick applied layer to ambient air for the typical machine cycle time is not sufficient to cure the white ink prior to application of the next color. In this instance, more rigorous curing is generally necessary immediately following application of such a white layer before any other color is applied.

One approach to solving this problem is presented in U.S. Pat. No. 5,595,113. As disclosed in this reference, an individual curing apparatus is mounted directly to the guide head portions $\mathbf{19}_a$ and $\mathbf{19}_b$ of a printing station subsequent to the heavy ink printing station. The curing device described in this reference supplants the normal print carriage 18 that would be conveyed by the guide head portions 19*a* and $\mathbf{19}_b$. Instead, reciprocation of these portions according to the normal sequence of the rotary machine causes the curing apparatus to be reciprocated over the workpiece platen and the thick ink layer to be cured. With this approach, the drying time for the thick layer is increased by the duration of an inking cycle.

One obvious problem with this approach is that a printing station is taken out of commission. Thus, in the example device shown in FIG. 1, an eight-station machine includes seven stations $\mathbf{15}_a$–$\mathbf{15}_h$ provided for applying one of seven different color layers. However, if the print carriage 18 from one of the stations is removed, one less color layer can be applied. Of course, in the system disclosed in the '113Patent, for each additional thick layer of ink to be applied, the print carriage of the next station must be replaced by a drying mechanism. It is not difficult to envision that a rotary printing apparatus with seven initial printing stations can be quickly reduced to an apparatus capable of only applying four different color layers where those layers are relatively thick. Adding printing stations to accommodate additional colors or printing layers is expensive. Moreover, space limitations may limit the size of the rotary printing apparatus, which therefore limits the number of available printing stations.

There is therefore a significant need in the printing industry for a mechanism that quickly and efficiently cures or dries even thick layers of applied ink in a continuous production system. In addition, the need exists for such a curing system that does not consume a printing station of the printing apparatus, or otherwise requires significant modification to the existing apparatus. A further need exists for a drying or curing system that does not adversely affect either the work in process or the printing screen material.

SUMMARY OF THE INVENTION

These needs are met by the present invention that provides a curing apparatus at each printing station. The inventive curing apparatus attaches to the existing structure supporting the printing mechanisms without interfering with the operation of those mechanisms. In one important feature of the invention, a flash curing unit is supported by a carriage that is movably mounted relative to the printing station so that the curing unit can be conveyed between the workpiece platen and the printing screen when the platen is in its retracted position. More specifically, the curing unit is operated when the printing cycle at each station is complete and prior to indexing the platen to the next printing station.

In one feature of the invention, a pair of rails are mounted to support components of the printing station, with the rails straddling the printing screen and workpiece platen of the screen printing machine. The carriage is slidably supported on the rails and is connected to a driving mechanism that reciprocates the carriage, and consequently the curing unit, across the work in process mounted on the platen. In one embodiment, the curing unit includes several high power lamps capable of generating temperatures up to 1200° F., depending upon the type of ink being cured. With this embodiment, the high temperature generated by the curing lamps is detrimental to the printing screen. Thus, in a further aspect of the invention, an insulator plate is disposed between the curing lamps and the printing screen. With this embodiment, the heat of the lamps is substantially contained beneath the curing unit and limited to the ink layer to be dried or cured.

In order to increase the efficiency of the curing unit, a number of reflector elements are mounted on the unit and arranged to reflect the radiant energy generated by the curing lamps downward toward the work in process. In one embodiment, the reflector elements are channel shaped and configured to receive one or two curing lamps within the channel. Preferably, the reflector elements have a polished surface facing the lamps to more efficiently reflect the radiant energy. Also preferably, the reflector elements are mounted to the underside of the insulator plate.

In certain embodiments of the invention, the curing apparatus includes an air blower at the distal end of the printing station. The air blower is arranged to provide ventilating air to the curing unit when it is retracted from its operating, or curing, position. In order to prevent any air from impinging on the printing screen of work in process, the air blower is provided with a deflector that deflects the air downward and away from the printing mechanisms.

The air blower helps cool the curing unit after the curing lamps at the end of a drying cycle. In another feature of the invention, the reflector elements are configured to maximize the ventilation around the curing lamps to help the lamps cool more quickly. In one aspect, the channel shaped reflector elements are arranged to form gaps of ventilation channels therebetween. In another aspect of the invention, the side walls of the channel shaped reflector elements define a series of slots so that air can flow through the ventilation channels and slots directly onto the curing lamps. Moreover, the slots prevent warping of the side walls when subjected to the intense heat generated by the curing lamps. In order to maintain the maximum reflectivity provided by the reflector elements, the elements are mounted to the curing unit so that no slots between adjacent reflector elements are aligned.

The curing apparatus according to the present invention can be readily integrated into a standard rotary printing system without interfering with the printing mechanisms at each printing station. One inventive curing apparatus can be mounted to each printing station, as desired. The curing apparatus includes a control box that control the timing of operation of the carriage driving the curing unit, and the curing unit itself. The control box can be electrically connected to the controller for the printing apparatus and utilize the timing and control signals from that controller to commence operation of the curing apparatus.

For example, the control box for the present invention can receive a signal from the printing apparatus controller indicating that the print cycle has been completed and the workpiece platen retracted. Before the platen is indexed to the next station, the control box directs the carriage to transport the curing unit between the printing screen and the work in process, energizes the curing unit for a predetermined period, and directs the carriage to return the curing unit to its home position.

The present invention accomplishes the significant advantage of providing a flash curing unit at every printing station, if desired. Another substantial benefit of the invention is that the curing apparatus can be attached to a print station without interfering with the movement or operation of the existing screen printing components.

One object achieved by the invention is that thin or thick ink layers on substrates can be cured or dried at each printing station. A further object is to provide this curing process without damaging the printing screen or marring the ink layer to be cured.

These and other advantages and objects provided by the present invention will become apparent upon consideration of the following written description and accompanying figures.

DESCRIPTION OF THE FIGURES

FIG. 10*b* is an end view of the station shown in FIG. 10*a* with the workpiece platen retracted from the screen and the drying apparatus, according to one embodiment of the present invention interposed there between.

DESCRIPTION OF THE PREFERRED EMBODIMENTS

Figure 1:
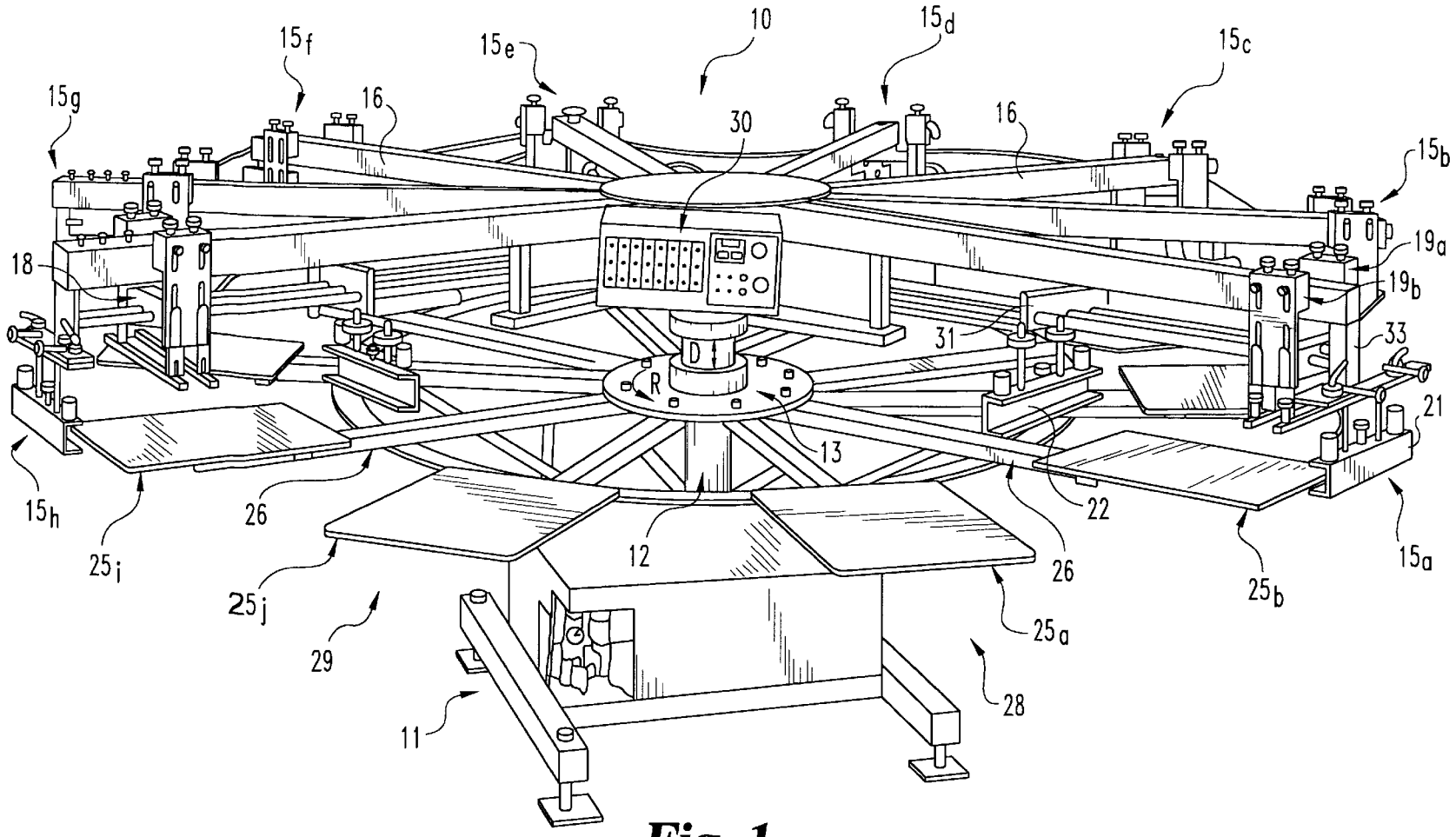
Fig. 1 (PRIOR ART)
FIG. 1 is a top perspective view of a rotary printing of the prior art.

For the purposes of promoting an understanding of the principles of the invention, reference will now be made to preferred embodiments illustrated in the drawings and specific language will be used to describe the same. It will nevertheless be understood that no limitation of the scope of the invention is thereby intended, such alterations and further modifications in the illustrated embodiment, and such further applications of the principles of the invention as illustrated therein being contemplated as would normally occur to one skilled in the art to which the invention relates.

The present invention contemplates a drying apparatus that can be readily mounted to any station of a printing apparatus, such as the rotary printing apparatus shown in FIG. 1. In accordance with the invention, the drying apparatus operates as an adjunct to the existing print carriage and does not otherwise interfere with the operation of the mechanism or the cycling of the workpiece between printing stations. In one embodiment of the invention, the drying apparatus is mounted at the outermost end of a station of the printing apparatus. The drying apparatus is fixed to the support structure at the station in a way so as not to interfere with the normal movement of the print carriage and other moveable components of the printing apparatus.

In one feature of the invention, the drying apparatus includes a pair of rail beams that straddle the existing printing station, and particularly the print carriage. A curing unit is supported by a carriage that is moveably mounted between the two rail beams. In particular, the curing unit is mounted so that it straddles the screen frame in its operative position. The curing unit has a height or thickness sufficiently small so that the curing units can travel between the screen printing frame and the platen when the platen is in the retracted, non-printing position. The invention contemplates that the drying apparatus is electrically connected to the controller for the printing apparatus so that the curing unit and carriage can cycle along the rail beams immediately when the platen has been withdrawn from the screen printing mechanism.

Figure 3:
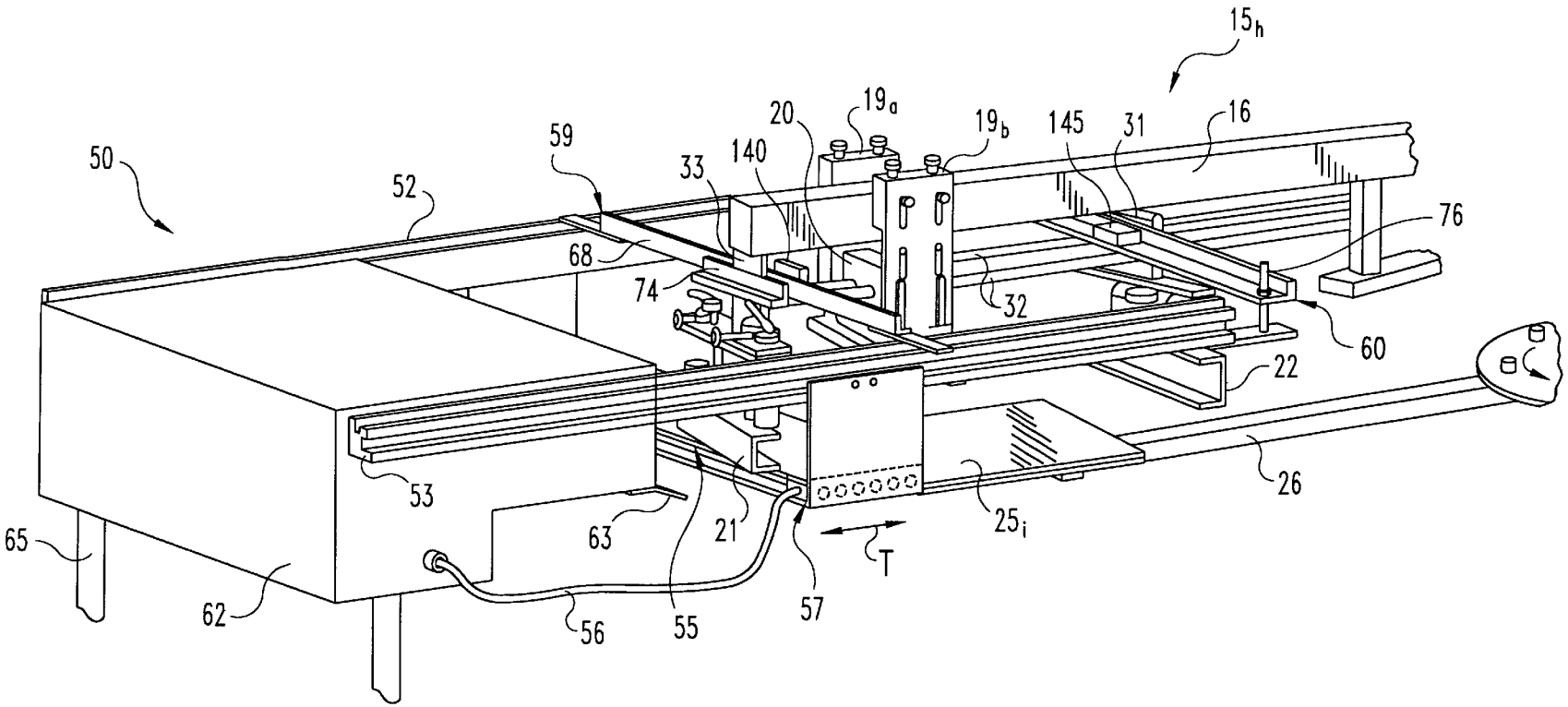
FIG. 3 is a side perspective view of a drying apparatus in accordance with one embodiment of the present invention mounted to a station of a rotary printing apparatus, such as the apparatus depicted in FIG. 1.

One embodiment of the invention is depicted in FIG. 3. In particular, the drying apparatus 50 includes a left rail beam 52 and a right rail beam 53 that is attached to the support structure of a station, such as station $\mathbf{15}_n$ of a rotary printing apparatus. A curing unit 55 is supported by a carriage 57 below the rail beams 52 and 53. More specifically, the carriage 57 is engaged to the beams to permit back and forth translation along the beams in direction of the arrows T. A power cable 56 extends from the curing unit 55 to a control box 62. The control box houses the electrical components for governing the operation of the curing unit 55, as well as the movement of the carriage 57 as a function of the cycle of the underlying printing machine.

Figure 2:
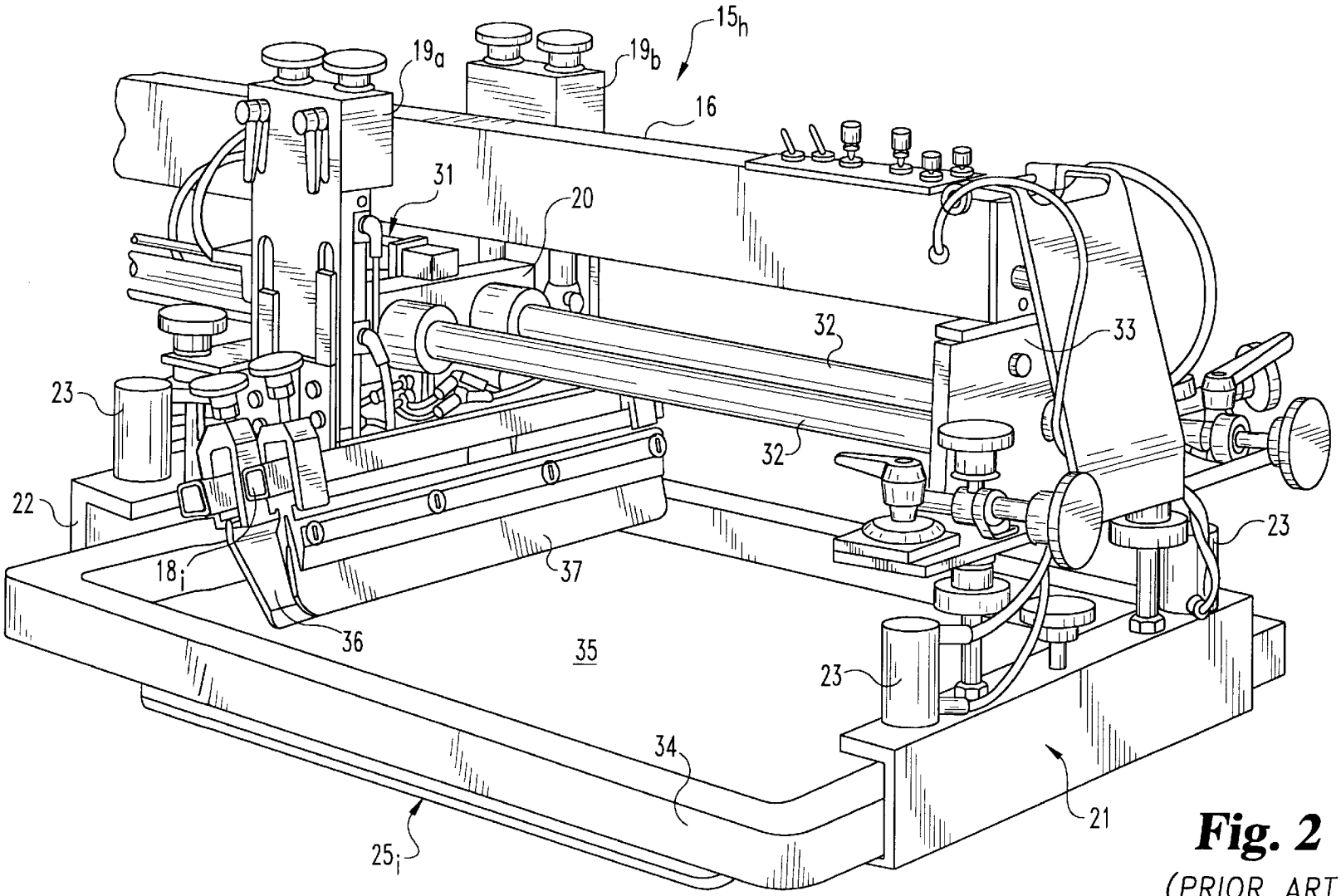
Fig. 2 (PRIOR ART)
FIG. 2 is an enlarged side-perspective view of one station of the rotary printing apparatus shown in FIG. 1.

The left and right rail beams 52 and 53 are mounted to the support structure at station $\mathbf{15}_h$ by a front mounting assembly 59 and a rear mounting assembly 60. In accordance with one feature of the invention, these mounting assemblies engage structural components of the station in such a manner so that the components of the drying apparatus 50 do not interfere with the operation of the print carriage 18 (see FIG. 2), or the guide head portions $\mathbf{19}_a$ and $\mathbf{19}_b$. In one specific embodiment, the front mounting assembly 59 engages the vertical front support 33 that supports the outer clamp 21 (See FIG. 2). The rear mounting assembly 60 in the specific illustrated embodiment, engages the guide shafts 32 just forward of the rear support 31.

In one embodiment of the invention, the drying apparatus 50 can be supported in cantilever fashion using only the front mounting assembly 59 and the rear mounting assembly 60. However, in a most preferred embodiment, the control box 62 is supported by one or more legs 65 projecting downward therefrom. This additional support not only helps carry the weight of the system; it also reduces the vibration that might be experienced by operation of the drying apparatus 50.

Figure 4:
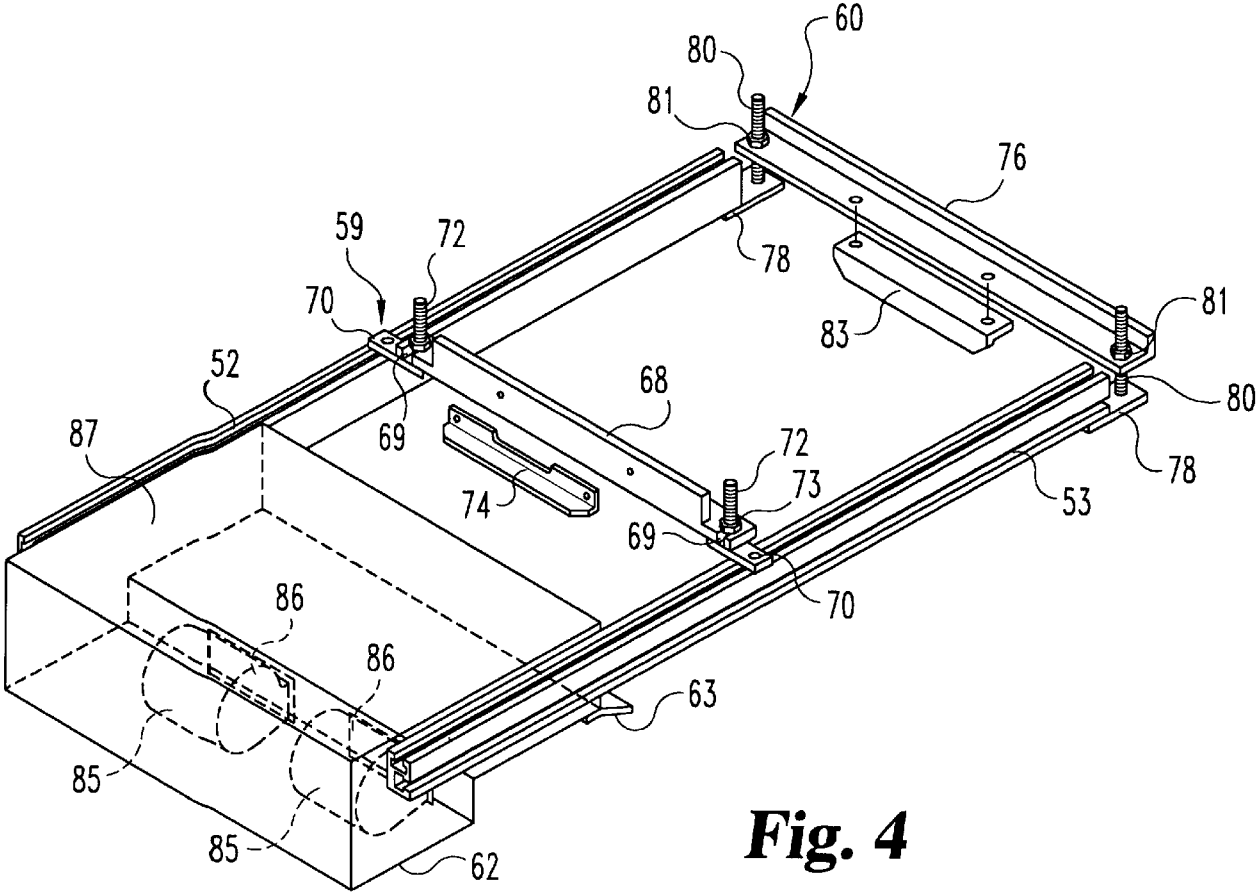
FIG. 4 is a top perspective view of components of the drying apparatus illustrated in FIG. 3.

Additional details of the drying apparatus, in particular the support structure are shown in FIG. 4. In one embodiment of the invention, the front mounting assembly 59 includes a front support bar 68 that spans between the rail beams 52 and 53. In the specific embodiment, a separate mounting bracket 69 is attached to the top of each of the rail beams by way of a bolt or similar fastener 70. A mounting screw 72 spans between the mounting bracket 69 and the front support bar 68. Preferably, the mounting screw 72 is passed upward through an opening (not shown) in the interior end of each mounting bracket 69, so that the screw 72 faces upward as shown in FIG. 4. Also, preferably, the front support bar 68 includes slots at its opposite ends that are oriented to receive the corresponding mounting screw 72 there through. A nut 73 can then be used to tighten down onto the screw 72 to fix the front support bar to the mounting bracket, and ultimately to the left and right rail beams 52 and 53.

A forward angle strap 74 is situated facing the front support bar 68. A nut and bolt or similar arrangement can be used to connect the angle strap 74 to the front support bar 68, and ultimately to clamp the two components about the front support 33 shown in FIGS. 3 and 11.

A similar arrangement can be used for the rear mounting assembly 60, depending upon the structure of the station for the particular printing apparatus. In other words, a similar clamping arrangement can be imposed on the rear support 31. However, in the illustrated embodiment, the rear mounting assembly 60 has a different configuration from the front mounting assembly. In particular, the rear mounting assembly includes a rear support bar 76 that again spans between the two beams 52 and 53. A mounting bracket 78 is connected at the ends of each of the beams 52 and 53 using a suitable fastener. In this embodiment, the mounting screw 80 projects upward from each of the mounting brackets 78 and directly through an opening at each end of the rear support bar 76. A nut 81 engages the mounting screw 80 to attach the rear support bar 76 ultimately to the left and right rail beams 52 and 53. A rear angle strap 83 is connected to the rear support bar 76 by way of suitable fasteners. In this portion of the specific embodiments, the guide shafts 32 are sandwiched between the rear support bar 76 and the rear angle strap 83. This same approach can be used for the front mounting assembly—i.e., the forward angle strap 74 and front support bar 68 can be sandwiched about forward end of the guide shafts 32

In one feature of the invention, the mounting screws 72 and 80, and corresponding nuts 73 and 81, can be used to align the left and right rail beams 52 and 53. More particularly, the beams should be parallel to the screen frame 34 and the workpiece platen 25, so that the curing unit 55 can move freely between these two components. Thus, the orientation of the rail beams 52 and 53 can be adjusted by threading or unthreading the nuts 73, 80 on the corresponding mounting screws 72, 80. Once the rails are properly oriented, the support legs 65 can be adjusted to provide greater stability to the cantilever mounted drying apparatus 50.

In one embodiment of the invention, the curing unit 55 utilizes high temperature lamps. Thus, the control box 62 can be provided with a number of blowers 85 that draw air through a plenum 87. The blowers are arranged adjacent blower openings 86 at the bottom of the control box 62. Air discharged by the blowers through the openings 86 passes across the curing unit 55 when the unit is in its retracted or neutral position. An air deflector 63 can be provided at the interior end of the control box 62 to deflect air away from the screen printing components. In some cases, air flowing across uncured, newly-applied layers of ink can cause disruption and flowing of the ink. Moreover, air flow across the printing screen can cause water-based inks to dry into the screen, rendering the screen useless. The air deflector 63 prevents these problems.

Figure 5:
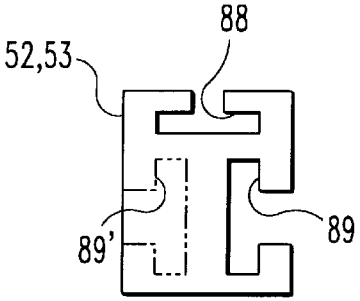
FIG. 5 is an end elevational view of a rail beam used with the drying apparatus shown in FIGS. 3 and 4.

In accordance with the preferred embodiment of the present invention, the left and right rail beam 52 and 53 are configured as shown in FIG. 5. In particular, the beams include an upper mounting channel 88 and a side slide channel 89. The upper mounting channel 88 can be used to engage the fastener 70 that attaches the mounting brackets 69 to the beams 52, 53. As is known, a nut or bolt can be slid through the channel 88 to an appropriate position and engage by a mating threaded components. As a modification of the front mounting assembly 59, the mounting brackets 69 can be eliminated and the front support bar 68 lengthened to span between the rail beams. With this modification, each mounting screw 72 can have a head portion configured to slid within an upper mounting channel 88, fixed against rotation as the nut 73 is tightened down onto the screw.

The slide channel 89 situated in the side of the beams 52, 53 is used to engage a slide bearing, or glide 95 at the interior of the carriage 57. In the specific embodiment, the beams include only one channel and are differently configured or opposite-handedly configured between the left rail beam 52 and right rail beam 53. Alternatively, a slide channel 89' can be formed in the side of the beam opposite the existing channel 89. With this configuration, the beam is interchangeable between the left and right sides of the drying apparatus 50.

Figure 6:
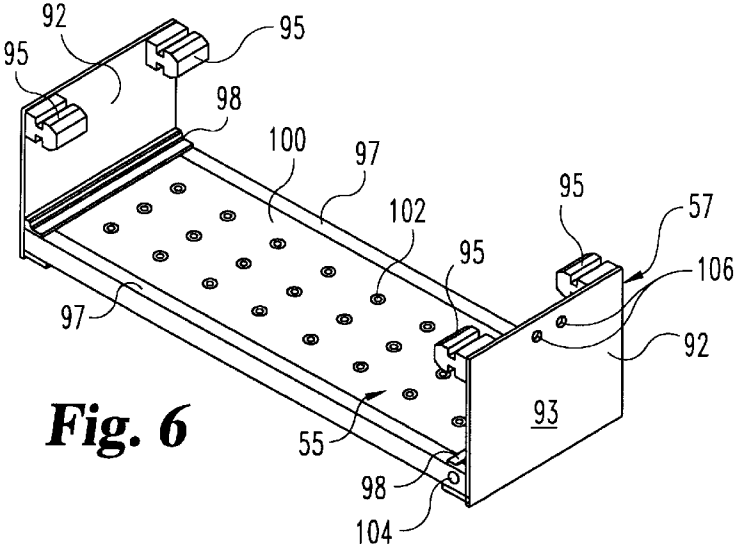
FIG. 6 is a top perspective view of a carriage and curing unit forming part of a drying apparatus shown in FIGS. 3 and 4.

The left and right rail beams 52 and 53 are used to slidingly support the carriage 57, which itself supports the curing unit 55. Details of these components are shown in FIGS. 6–9. As shown in FIG. 6, the curing unit 55 is supported by the carriage 57 by a pair of socket housings 92. Each of the housings 92 includes a vertically-disposed side panel 93. A pair of cross bars 97 are attached to each of the socket housings 92 to form a generally rectangular frame. The cross bars 97 have a length that is sufficient to span beyond the width of the screen frame 34. A pair of socket plates 98 complete the assembly for the frame of the carriage 57.

A pair of the glides 95 are aligned at the upper inner surface of each of the side panels 93. These glides are configured to be engaged within a slide channel 89 of one of the rail beams 52 or 53. Preferably, the glides are formed of a Teflon material or similar material configured for low friction, high endurance, sliding along slide channels 89. Alternatively, the glides 95 can be replaced by a pair of roller wheel assemblies. The principal requirements of the glides 95 or their equivalent is that the carriage 57 be permitted to freely slide along the two rail beams 52, 53.

In accordance with one aspect of the preferred embodiment of the invention, the rectangular frame forming the carriage 57 supports an insulator plate 100. When the carriage 57 is in its operative position, as shown in FIG. 3, the insulator plate 100 is oriented closest to the screen 35. As discussed more fully herein, the insulator plate prevents heat damage to the screen and printing mechanism.

Figure 7:
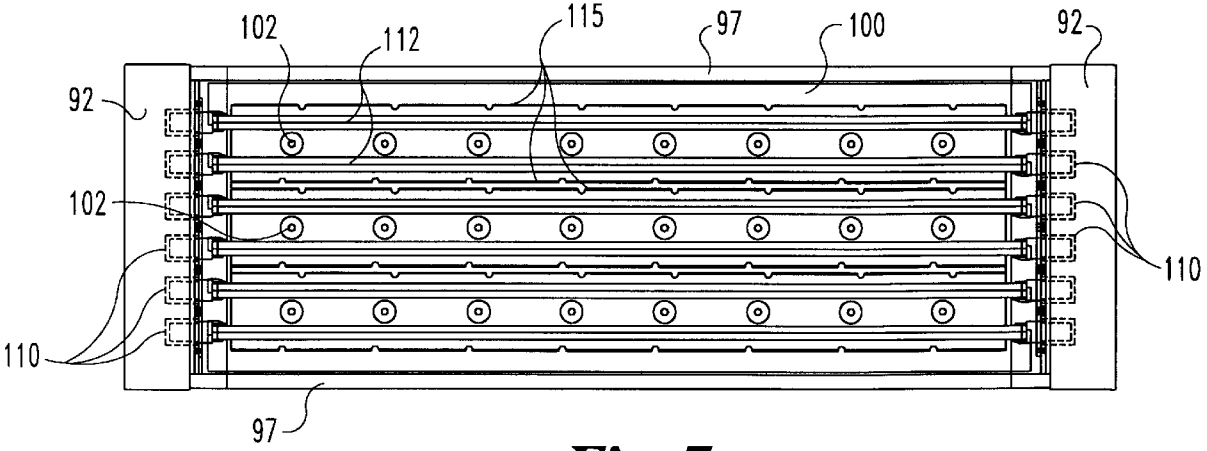
FIG. 7 is a bottom elevational view of the curing unit and carriage shown in FIG. 6

As depicted in FIG. 7, an array of lamps 112 are disposed directly beneath the insulator plate 100. Each of the lamps 112 is mounted between opposite electrical sockets 110 supported by one of the two socket housings 92. Electrical power is provided to each of the sockets 110, and ultimately the array of lamps 112, through a power cable socket 104 and power cable 56 connected to the electrical components within control box 62 (FIG. 3). Preferably, the cable is long enough to extend the entire length of travel T of the carriage 57. A cable take-up and/or strain relief component can be included with the cable 56 and/or cable socket 104, as is known in the art.

In accordance with the preferred embodiment of the invention, each curing unit 55 includes a source of radiant energy, such as six lamps 112. Preferably, these lamps are high-powered quartz tubes that can be quickly energized and de-energized in response to control signals from the control box 62. The quartz lamps 172 are preferably capable of generating temperatures of up to 1200 degrees Fahrenheit, depending upon the type of ink being cured. Lower temperatures in the range of 200–230° F. have been found to be sufficient to cure Plastisol gel inks.

Figure 8:
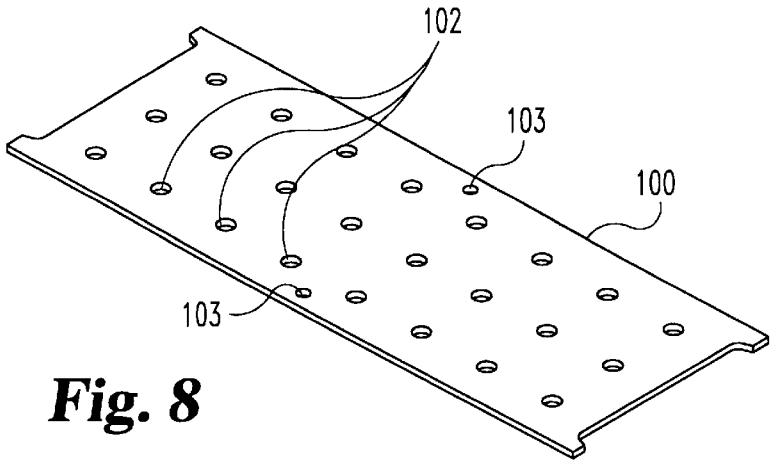
FIG. 8 is a top perspective view of an insulated plate forming part of the curing unit shown in FIGS. 6 and 7.

The quartz lamps 112 can be similar to lamps used in mobile flash curing units, such as those described above. In these mobile systems, however, only the article in process and workpiece platen are exposed to the heating element. With the present invention, the heating element travels in the gap between the ink layer applied to the article in process and the silk screen 35. The use of high-powered quartz lamps 112 poses a significant risk to the silk screen 35 as the heat rises up to the screen. Consequently, in another feature of the invention, the curing unit 55 includes a number of reflector elements 115, most clearly depicted in FIGS. 7 and 9. In the preferred embodiment, three reflector elements 115 are mounted to the underside of the insulator plate 100 at a number of attachment points 102. Preferably, each of the attachment points 102 is recessed within the insulator plate 100, as shown in FIG. 8. Likewise, the attachment points 103 for engaging the insulator plate 100 to each of the cross bars 97 can be recessed, as depicted in the detail view of FIG. 8.

Returning to FIG. 9, the arrangement of the reflector elements 115 is illustrated. In the preferred embodiments, two lamps 112 pass through each of the channel-shaped reflector elements 115. Each reflector element includes a plate portion 117 that is mounted to the underside of the insulator plate 100 at attachment points 118. The reflector elements 115 also include opposite upstanding side walls 120. The side walls preferably have a height that is greater than the height of lamps 112 traversing through the channel of the reflector elements 115. Each of the elements is preferably formed of stainless steel or similar material that is capable of enduring exposure to high temperatures and radiant energy. Moreover, the interior of the channel of the channel formed by each of the reflector elements 115 is preferably highly polished to enhance reflection of the radiant energy generated by each of the lamps 112.

As might be expected, the use of the lamps 112 and reflector elements 115 generates a significant amount of heat within the channels of each of the reflector elements. Thus, provisions for ventilation around the lamps and through the reflector elements is provided. Specifically, the reflector elements 115 are offset relative to each other to form ventilation gaps 122 between adjacent elements. Air can then flow between the adjacent reflector elements to cool the elements when the lamps are de-energized.

Figure 9:
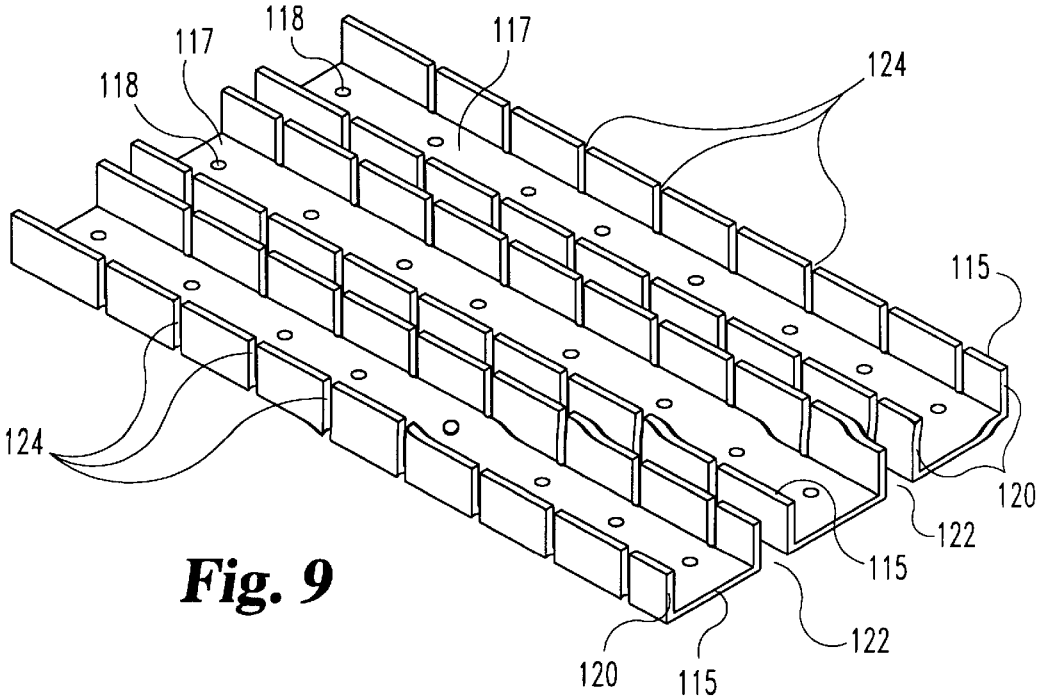
FIG. 9 is a bottom perspective view of reflector elements forming part of the curing unit depicted in FIGS. 6 and 7, in one embodiment of the invention.

In a further feature of the invention, the side walls 120 of the reflector elements 115 are segmented to form a number of ventilation slots 124. Each of the slots provides an additional air flow path to help cool the plate portion 117 of the reflector elements as well as the high energy lamps 112. In addition, the slots reduce the likelihood of heat-induced distortion of the reflector elements. The slots 124 leave room for heat expansion of the side walls that would otherwise warp the reflector elements 115 and insulator plate 100. In one aspect of this embodiment, the slots 124 of adjacent reflector elements 115 are offset as depicted in FIG. 9. In other words, the slot in the side wall of one reflector element directly faces a side wall of the adjacent element, rather than a slot opening in the element. This aspect preserves the ventilation and cooling capacity of the curing units, while maintaining the reflectivity of each element.

Figure 10A:
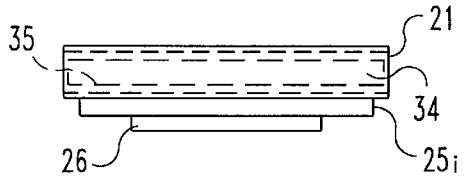
FIG. 10*a* is an end view of a printing station with the workpiece platen and printing screen in position to apply a layer of ink to the item to be printed.
Figure 10B:
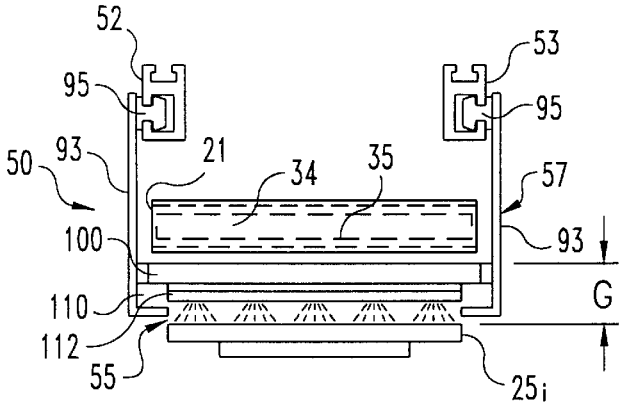

The operation of the drying apparatus 50 according to the present invention is illustrated in FIGS. 10*a* and 10*b*. In FIG. 10*a*, one portion of a particular station of the printing apparatus, such as that depicted in FIG. 3, is illustrated. More specifically, the outer clamp 21 and the silk screen frame 34 of the station is shown. In addition, the workpiece platen $\mathbf{25}_i$ and its platen arm 26 are depicted in end view. As shown in this figure, the workpiece platen is in its operative position, meaning that the platen is brought to within about $1/16^{th}$ inch of the printing screen 35 supported within the clamps 21 and 22. (Note that the squeegee 37 presses the screen against the substrate supported by the platen.) This inking position shown in FIG. 10*a* is well known as the orientation in which the ink layer is transmitted through the screen 35 onto the article in process supported by the platen 26. It is also known that the workpiece platen $\mathbf{25}_i$ is translated upward by hub 13 (see FIG. 1) and pressure is maintained between the platen and screen 35 to ensure a smooth application of the ink layer to the work in process. The amount of time that this pressure contact is maintained is governed by the controller 30 of the printing apparatus 10.

Turning now to FIG. 10*b*, the workpiece platen $\mathbf{25}_i$ has been retracted or moved downward away from the screen 35 in response to a control signal from the printing apparatus controller 30. This sequence of movements is also well known from typical silk screen printing processes and can follow a predetermined sequence of component movements. Once the print carriage 18 has applied the layer of ink to the workpiece, the platen $\mathbf{25}_i$ can be moved away from the silk screen in preparation for indexing the platen to the next printing station.

It is at this point that the drying apparatus 50 of the present invention is operated. Specifically, the carriage 57 is energized to travel along the left and right rail beams 52, 53 until the curing unit 55 is disposed in the gap G between the bottom of the screen frame 34/screen 35 and the top of the workpiece platen $\mathbf{25}_i$. The carriage 57 and curing unit 55 are sized so that the curing unit can readily travel through the gap G between the existing components of the rotary printing apparatus 10. In this position, radiant energy from the lamps 112 is directed onto the ink layer applied to the substrate supported by the platen.

At the same time, the insulator plate 100 reduces the amount of heat conduction or convection upward toward the silk screen 35. The thickness of the insulator plate 100 can be calibrated to minimize the upward heat transfer from the lamps 112 to the silk screen 35. For instance, the amount of heat transfer that might affect the silk screen 35 is a function of the heat generated by the lamps 112, the amount of heat reflected by the reflector elements 115, and the amount of time that the drying apparatus 50 is traveling through the gap G. For a given amount of generated heat, the faster that the drying apparatus 50 completes its cyclic path over the work in process, the lower the heat transfer to the silk screen 35. A thinner insulator plate 100 can be used in this instance, versus the instance in which the travel or cycle time for the curing unit 55 is longer. In a specific embodiment, the insulator plate has a thickness of 0.250 inches and is formed of a silica-type or ceramic material having a relatively low thermal conductivity.

The high-powered lamps 112 are energized when the curing unit 55 begins to traverse the gap G above the substrate in process. Preferably, the width of the curing unit 55 is less than the total length of the workpiece platen $\mathbf{25}_i$ so that the carriage 57 must travel from one end of the platen to the other. This type of movement prevents overheating any particular segment of the applied layer of ink and takes full advantage of any slight convective air flow across the work in process to speed up the curing of the ink layer.

With the present invention, it is important that the cycle time of the drying apparatus be as short as possible while still effectively curing the layer of ink. In one specific embodiment, the curing unit 55 is cycled back and forth across the workpiece platen in about six seconds. It is important that the movement of the drying apparatus be coordinated with the ordinary cycling of the workpiece platens and the raising and lowering of the platens by the controller 30.

In one alternative embodiment, the curing unit 55 is energized only in one direction of travel, namely from its neutral or home position immediately below and adjacent to the control box 62 to its remote position adjacent the rear support 31 of the printing station. With this approach, the curing unit and carriage can be retracted to their home position while the workpiece platens are being cycled to their next location.

Whether the curing unit 50 of the drying apparatus operates on one or two strokes across the workpiece platen 25, some modification to the sequencing and cycling of the platens may be needed. More specifically, a particular dwell time may be required after the work in process has been inked. However, even with the slight increase of the cycle time caused by adding a short dwell time at thick film printing stations, the overall process time is not significantly affected relative to a prior processes and drying systems.

Once the carriage 57 and curing unit 55 have returned to their home position, air flowing from the control box 62 helps cool the lamps 112 and reflector elements 115. Thus, as shown more clearly in FIG. 11, the blowers 85 mounted within the control box 62 direct a flow of air A through the blower openings 86 toward the curing unit 55. Preferably, the blowers are continuously operating to maximize the amount of time that the hot curing unit 55 is exposed to the cooling air flow A. In this instance, it is important to keep the air from flowing across either the work in process on the workplace platen or the screen at the printing station. As indicated above, air flow across these components can disrupt the ink layer before it is fully cured, and can cause damage to the silk screen itself. Consequently, the inventive drying apparatus contemplates a deflector 63 mounted at the front end of the control box to deflect any air flow away from the printing components. As the carriage 57 and curing unit 55 return to the home position, the air flow is continuously directed across the top and bottom of the curing units to cool the insulator plate 100, the lamps 112, and the reflector elements 115 in preparation for a further cycle.

Figure 11:
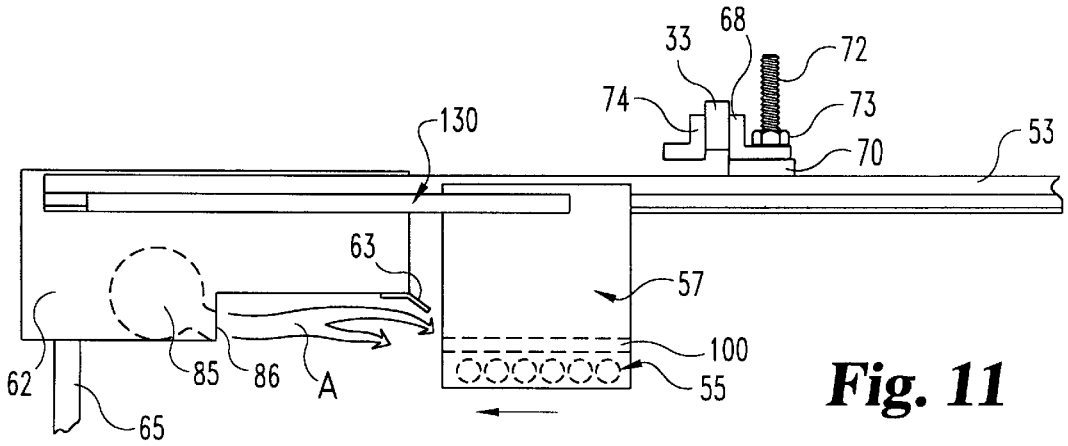
FIG. 11 is a side elevational view of the drying apparatus as mounted to a station of a printing apparatus, as depicted in FIG. 3.

As depicted in FIG. 11, the carriage 57 is propelled or driven by a drive member 130. This drive member can be attached to one or both side panels 93 at attachment points 106. In the preferred embodiment, the drive member 130 is a hydraulic or pneumatic cylinder connected to the control box 62 and operated in response to control signals generated by the electrical components of the control box. The drive member 130 can be of a variety of configurations provided that it can reciprocate the carriage 57 and curing unit 55 across the workpiece platen in a timely fashion. For example, the drive member can constitute an electric drive motor, spring drive, or the like.

In the preferred embodiment of the invention, the control box 62 houses the electrical or electronic components for directing the movement of the carriage and energization of the curing unit. These components can be of many types known in the industry. For instance, the control box can house an array of relays that are tripped by a timing actuator to provide power to the various components of the drying apparatus 50. The apparatus can also include an array of switches, such as proximity (Hall type) or trip switches mounted at the limits of travel of the carriage 57. The switches can provide signals to the control box to reverse the direction of movement of the carriage when it is at the end of its travel over the platen 25, or to de-energize the drive member 130 when the carriage is at its home position adjacent the control box 62.

Alternatively, the control box can house a programmable logic controller that provides energization and de-energization signals to the working components of the drying apparatus 50. This form of controller can constitute an integrated circuit board that provides signals to the relays or similar device actuators. Preferably, the on-board electrical or electronic components of the control box 62 are electrically connected to the main controller 30 of the printing apparatus 10. More specifically, the control box receives cycling information from the controller to determine the start time for the drying apparatus 50. For example, in certain printing apparatuses, the controller generates a signal causing the hub 13 to be lowered, thereby retracting the platens 25 from the printing screens 35. The drying apparatus of the present invention can be triggered from this signal so that the curing unit 55 begins its travel as the platen is being lowered.

The drying/curing apparatus 50 of the present invention can be mounted to any number of printing stations 15 of a printing apparatus. For instance, the drying apparatus 50 can be connected to only those stations applying a thick ink layer to the workpiece substrate. The forward and rear mounting assemblies 59, 60 of the invention allow the drying apparatus to be readily installed and/or removed from a printing station without disrupting the printing apparatus. Thus, the number and location of drying apparatuses can be changed with the printing job being executed by the printing apparatus.

While the invention has been illustrated and described in detail in the foregoing drawings and description, the same is to be considered as illustrative and not restrictive in character, it being understood that only preferred embodiments thereof have been shown and described and that all changes and modifications that come within the spirit of the invention are desired to be protected. For example, the drying apparatus 50 of the preferred embodiment is mounted on a rotary or turret-type printing machine 10. The drying apparatus can also be mounted on other forms of sequential printing machines, provided the printing machine implements an operational step in which the substrate in process is retracted from a printing screen.

In a further modification, the initiation of the curing apparatus 50 can be accomplished without reference to signals generated by the main controller 30 of the printing machine 10. In this case, a pair of sensors 140 and 145 can be electrically connected to circuitry within the control box 62. The sensors 140, 145 can sense the proximity of the guide head portions 19*a*, 19*b*, or the center support 20 as the print carriage 18 is cycled. The sensors 140, 145 can be known proximity sensors, such as an air switch or a Hall sensor. In this modification, the sensor 140 can be mounted to the front mounting assembly 59, such as on the front support bar 68. Likewise, the sensor 145 can be mounted to the rear support assembly 60, or the rear support bar 76.

The front sensor 140 can provide a signal to the control box 62 when the print carriage 18 has been drawn across the printing screen. This signal provides an indication that a printing operation has occurred at the station. In the absence of such a signal, there is no reason to activate the drying/curing apparatus 50. When a signal is generated by the front sensor 140, the control box can await receipt of a signal from the rear sensor 145 as an indication that the print carriage 18 has completed its printing cycle. The control box 62 can then activate the carriage 57 as described above. Alternatively, only the rear sensor can be utilized to provide a first signal when the print carriage moves away from the rear mounting assembly and a second signal when the print carriage returns to its home position adjacent the rear mounting assembly 60.

This modification achieves certain functions that cannot be accomplished by prior portable curing devices. For instance, the curing apparatus 50 can be operated only when ink has been applied. In addition, the apparatus 50 can be activated for each printing cycle at a given station when multiple layers are applied at that station. The control box 62 can be configured to cycle the curing apparatus after a predetermined number of printing cycles has occurred. Thus, a station can execute printing and curing cycles in various sequences, such as "Print-Cure-Print" or "Print-Print-Cure".

What is claimed is:

1. An apparatus for curing a layer of ink applied to a substrate by a screen printing apparatus, the printing apparatus having at least one station including a support arm supporting a printing screen and a movable print carriage for applying an ink layer to the substrate through the screen, the printing apparatus further having a platen for supporting the substrate and movable from a printing position in which the substrate is pressed against the printing screen and a retracted position in which the platen is apart from the screen leaving a gap therebetween, said apparatus for curing comprising:

a curing unit including;

an insulator plate having a lower surface and an opposite upper surface; and at least one heat generating element supported adjacent said lower surface, wherein the insulator plate and the at least one heat generating element define a height dimension less than the gap when the platen is in its retracted position, and wherein said insulator plate is configured to reduce heat transfer from said at least one heat generating element to the printing screen;

means for supporting said curing unit on the support arm at the one station of the printing apparatus; and means for moving said curing unit between the platen and the printing screen with said upper surface of said insulator plate facing the printing screen and the heat generating element facing the substrate when the platen is in its retracted position.

2. The apparatus for curing according to claim 1, wherein:

said means for supporting includes a pair of rails mounted to the support arm of the one station of the screen printing apparatus with said rails straddling the station; and said means for moving includes;

a carriage slidably mounted between said pair of rails and connected to said curing unit to support said curing unit between the platen and the printing screen with said upper surface of said insulator plate facing the printing screen when the platen is in its retracted position; and a mechanism operable to move said carriage along said rails so that said at least one heat generating element of said curing unit passes over the substrate supported by the platen when the platen is in its retracted position.

3. The apparatus for curing according to claim 2, wherein said means for supporting includes at least one clamping member connected to said pair of rails and configured to clamp on a portion of the support arm of the screen printing apparatus.

4. The apparatus for curing according to claim 3, wherein said means for supporting includes a mechanism for adjusting the attitude of said pair of rails relative to the printing screen.

5. The apparatus for curing according to claim 4, wherein said means for supporting includes:

a pair of screws, one each attached to a corresponding one of said rails;

a bar spanning between said pair of rails and having a pair of openings, one each at opposite ends of said bar configured to receive a corresponding one of said pair of screws therethrough; and a pair of adjustment nuts, one each threadedly engaging a corresponding one of said screws at variable positions along said corresponding screw.

6. The apparatus for curing according to claim 3, wherein said means for supporting includes a pair of clamping members, one of said clamping members connected at one end of said pair of rails and the other of said clamping members connected at an intermediate position on said pair of rails so that a portion of said pair of rails is cantilevered beyond the end of the printing apparatus station when said pair of clamping members is clamped to the support arm of the printing apparatus.

7. The apparatus for curing according to claim 6, further comprising a control box mounted to said cantilevered portion of said pair of rails, said control box housing circuitry for supplying power to said curing unit.

8. The apparatus for curing according to claim 7, wherein said control box includes at least one ground engaging leg projecting downward therefrom for supporting said control box and said cantilevered portion of said pair of rails.

9. The apparatus for curing according to claim 7, wherein said control box include means for blowing air onto said curing unit when said unit is adjacent said control box.

10. The apparatus for curing according to claim 9, wherein said control box includes an air deflector to deflect air from said means for blowing away from the printing screen.

11. The apparatus for curing according to claim 1, wherein said curing unit further includes at least one channel shaped reflector element connected to said curing unit between said at least one heat generating element and said insulator plate, said reflector element having a reflective surface facing said at least one heat generating element.

12. The apparatus for curing according to claim 11, wherein said at least one reflector element is mounted to said lower surface of said insulator plate.

13. The apparatus for curing according to claim 11, wherein said curing unit includes;

a plurality of heat generating elements; and a number of channel shaped reflector elements connected to said curing unit, each straddling an adjacent pair of said heat generating elements.

14. The apparatus for curing according to claim 11, wherein said at least one channel shaped reflector element includes a plate portion and opposite side wall portions projecting outward from said plate portion, each of said side wall portions having a width substantially equal to said height dimension and each defining a plurality of slots therethrough extending along a substantial portion of said width.

15. The apparatus for curing according to claim 11, wherein said curing unit includes;

a plurality of heat generating elements; and at least two channel shaped reflector elements connected to said curing unit between corresponding ones of said heat generating elements and said insulator plate.

16. The apparatus for curing according to claim 15, wherein said at least two reflector elements are spaced apart to define a ventilation gap between adjacent reflector elements.

17. The apparatus for curing according to claim 15, wherein said at least two channel shaped reflector elements each include a plate portion and opposite side wall portions projecting outward from said plate portion, each of said side wall portions defining a plurality of slots therethrough.

18. The apparatus for curing according to claim 17, wherein said at least two channel shaped reflector elements are connected to said curing unit so that said plurality of slots in adjacent side wall portions of adjacent reflector elements are not aligned.

19. The apparatus according to claim 1, wherein said insulator plate includes a ceramic or silica material.

20. The apparatus according to claim 1, further comprising a blower device disposed adjacent the station of the printing apparatus for blowing air over said curing unit, said blower device having a deflector for diverting air from the printing screen and substrate when the platen is in its retracted position.

21. The apparatus according to claim 1 in which the printing apparatus includes a main controller providing signals for controlling the operation of the print carriage and platen, wherein said means for moving said curing unit includes:

a power mechanism operable to move said curing unit between the platen and printing screen; and a control unit electrically connected to the main controller and operable to activate said power mechanism in response to receipt of a signal from the main controller.

22. The apparatus according to claim 1, wherein said means for moving said curing unit includes:

a power mechanism operable to move said curing unit between the platen and printing screen;

a sensor array for generating a signal when the print carriage has applied an ink layer; and a control unit operable to active said power mechanism in response to receipt of said signal from said sensor array.

23. The apparatus according to claim 22, wherein:

said sensor array includes;

a first sensor adjacent the home position of the print carriage, operable to generate a first signal when the print carriage is adjacent thereto; and a second sensor adjacent the end of the stroke of the print carriage, operable to generate a second signal when the print carriage is adjacent thereto; and said control unit is operable to activate the power mechanism after successive receipt of said first and second signals.

* * * * *

UNITED STATES PATENT AND TRADEMARK OFFICE

CERTIFICATE OF CORRECTION

PATENT NO. : 6,152,030
DATED : November 28, 2000
INVENTOR(S) : Rick Lee Fuqua

It is certified that error appears in the above-identified patent and that said Letters Patent is hereby corrected as shown below:

Column 9,
Line 44, replace "172" with -- 112 --

Signed and Sealed this

Twenty fifth Day of September, 2001

*Attest:*

Nicholas P. Godici

NICHOLAS P. GODICI
*Acting Director of the United States Patent and Trademark Office*

*Attesting Officer*